US005530433A

United States Patent [19]

Morita

[11] Patent Number: 5,530,433

[45] Date of Patent: Jun. 25, 1996

[54] SMOKE DETECTOR INCLUDING AMBIENT TEMPERATURE COMPENSATION

[75] Inventor: Toshikazu Morita, Tokyo, Japan

[73] Assignee: Nohmi Bosai, Ltd., Tokyo, Japan

[21] Appl. No.: 219,488

[22] Filed: Mar. 29, 1994

[30] Foreign Application Priority Data

Mar. 31, 1993 [JP] Japan ..... 5-096714

[51] Int. Cl.[6] ..... G08B 17/00

[52] U.S. Cl. ..... 340/630; 340/628; 340/584; 374/178; 250/573; 250/574

[58] Field of Search ..... 340/628, 630, 340/584; 250/573, 574; 374/100, 178

[56] References Cited

U.S. PATENT DOCUMENTS

| | | | |
|---|---|---|---|
| 3,604,957 | 9/1971 | Satula | 374/178 |
| 3,873,857 | 3/1975 | Farrish | 374/178 |
| 4,249,169 | 2/1981 | Malinowski | 340/630 |
| 4,266,220 | 5/1981 | Malinowski | 340/630 |
| 4,321,466 | 3/1982 | Mallory et al. | 250/574 |
| 4,420,746 | 12/1983 | Malinowski | 340/630 |
| 4,484,050 | 11/1984 | Horinouchi et al. | 340/584 |
| 5,254,975 | 10/1994 | Torikoshi | 340/584 |
| 5,448,224 | 9/1995 | Mochizuki | 340/589 |

FOREIGN PATENT DOCUMENTS

| | | |
|---|---|---|
| 418409 | 3/1991 | European Pat. Off. . |
| 2230853 | 10/1990 | United Kingdom . |

OTHER PUBLICATIONS

Patent Abstracts Of Japan, vol. 5, No. 32, (P–050), 27 Feb. 1981.

IBM Technical Disclosure Bulletin, vol. 21, No. 11 (Apr. 1979).

*Primary Examiner*—Brent A. Swarthout
*Assistant Examiner*—Julie B. Lieu
*Attorney, Agent, or Firm*—Wenderoth, Lind & Ponack

[57] ABSTRACT

A smoke type fire detector accurately detects a smoke density even when an internal temperature thereof changes. An internal temperature detecting unit detects an ambient temperature at a light emitting element and a light receiving element. A correction coefficient having a value associated with the ambient temperature detected by the temperature detecting unit is used to correct an output level of the light receiving element.

5 Claims, 4 Drawing Sheets

SMOKE DETECTOR INCLUDING AMBIENT TEMPERATURE COMPENSATION

BACKGROUND OF THE INVENTION

1. Field of the Invention

The present invention relates to temperature compensation for a smoke type fire detector.

2. Description of the Related Art

A smoke type fire detector comprises a light emitting element and a light receiving element both lying in a smoke room. Light emanating from the light emitting element is reflected irregularly due to smoke. The irregularly-reflected light is received by the light receiving element. A level of an output signal of the light receiving element is amplified-by an amplifier. A smoke density is then identified using the amplified level of the output signal.

Temperature varies depending on an environment of a site at which a detector is installed. Ambient temperature at the detector varies depending on the installation site. Specifically, the temperature in the vicinity of a roof of a building is very high due to solar thermal power, while the temperature in basement made of a non-adiabatic concrete is very low. There is a great difference in temperature conditions between them. The ambient temperature at the detector is greatly affected by the climate associated with the latitude at an installation site or the presence or absence of an air conditioner.

The sensitivity of a detector is adjusted under substantially the same temperature conditions at a factory. Assuming that the sensitivity of a detector varies depending on temperature, even if the sensitivity is adjusted during a manufacturing process of adjustment at a factory, the sensitivity may vary depending on an installation site.

For example, a light emitting diode (LED) is employed as a light emitting element and a photodiode is employed as a light receiving element. The LED has such a temperature characteristic that the quantity of light emanating therefrom varies at −0.6%/°C. The photodiode has such a temperature characteristic that the output level thereof varies at +0.2%/°C. The overall temperature characteristic of the LED and photodiode comes therefore to −0.6%/°C.+0.2%/°C.=−0.4%/°C. Even when an actual smoke density remains unchanged, if an internal temperature of a smoke type fire detector changes, the output level of the light receiving element varies at −0.4%/°C. Specifically, when the internal temperature of the smoke type fire detector changes by 50° C., the output level of the light receiving element varies by 20%.

Aside from the light emitting element and light receiving element, an amplifier composed of semiconductor elements has a temperature characteristic. As the temperature within a detector changes, the level of an output of the amplifier varies due to the temperature characteristics of the semiconductor elements.

Thus, the output level is affected by a complex temperature characteristic of all components of a detector. The variation in output level is not monotonous relative to a temperature. A conventional method of compensation using a temperature compensation element such as a thermistor cannot therefore achieve temperature compensation satisfactorily.

SUMMARY OF THE INVENTION

An object of the present invention is to provide a smoke type fire detector capable of detecting a smoke density accurately at different ambient temperatures thereof.

The present invention comprises a temperature detecting means for detecting an ambient temperature at a light emitting element and a light receiving element, and a temperature compensating means for correcting an output level of the light receiving element according to the ambient temperature detected by the temperature detecting means.

Even when the internal temperature of a smoke type fire detector changes, a smoke density can be detected accurately.

DETAILED DESCRIPTION OF THE PREFERRED EMBODIMENTS

Figure 1:
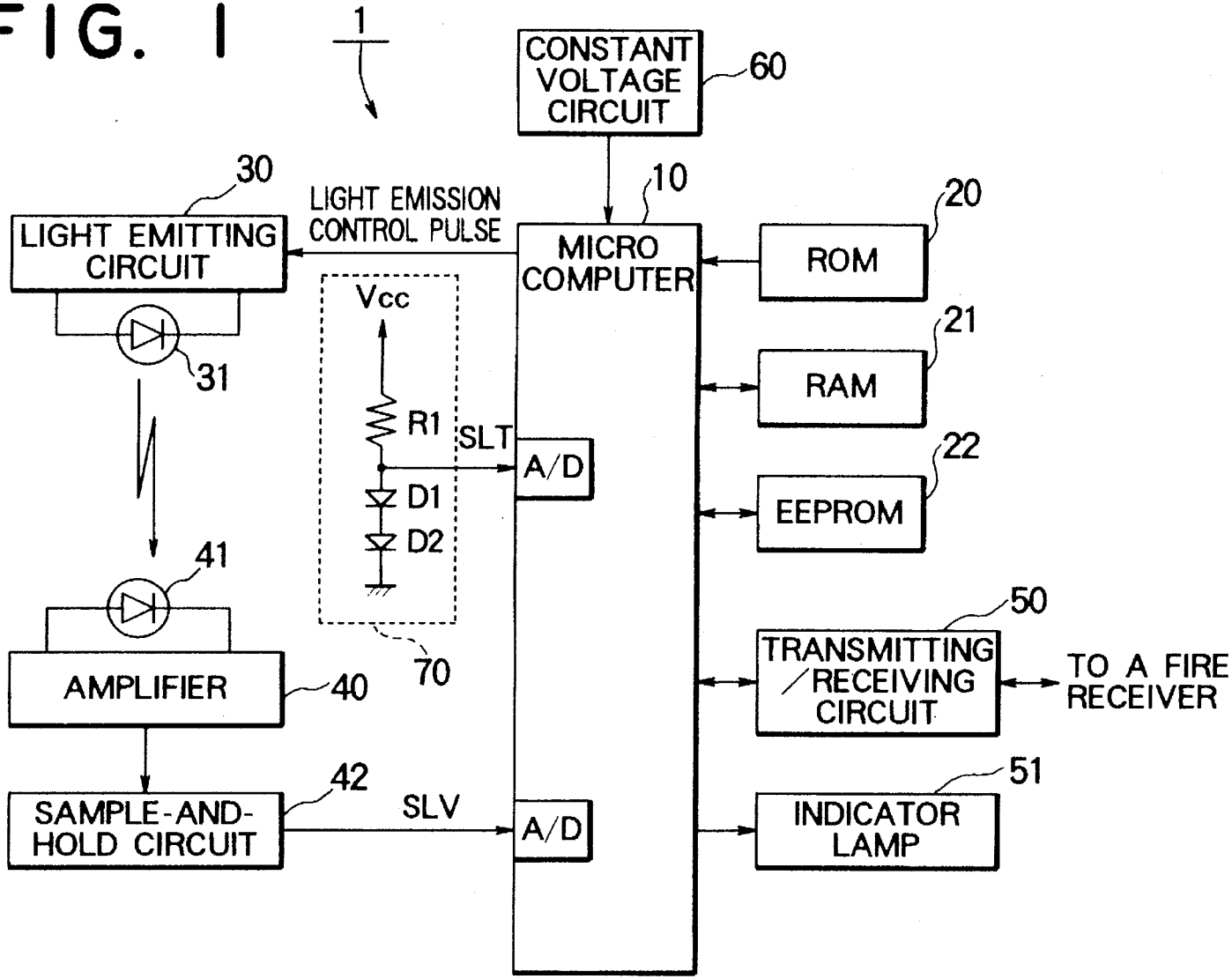
FIG. 1 is a block diagram showing a smoke type fire detector of an embodiment of the present invention.

FIG. 1 is a block diagram showing a smoke type fire detector 1 of an embodiment of the present invention.

In this embodiment, a microcomputer 10 controls the whole of the smoke type fire detector 1. A ROM 20 contains a program shown in FIG. 2. A RAM 21 offers a work area and stores an output voltage SLT of an internal temperature detecting unit 70, an output voltage SLV of a sample-and-hold circuit 42 for holding an output signal sent from an amplifier 40, and a calculated smoke density.

An EEPROM 22 stores addresses of the smoke type fire detectors in a fire alarm system and a correction coefficient K. The correction coefficient K assumes various values predetermined in association with detected temperatures, which is used to correct the output voltage SLV of the sample-and-hold circuit 42.

In response to a light emission control pulse sent from the microcomputer 10, a light emitting circuit 30 supplies current pulse for light emission to a light emitting element 31. The amplifier 40 amplifies an output level of a light receiving element 41 by a given gain. A transmitting/receiving circuit 50 includes a transmitting circuit for sending a fire signal, a signal representing a physical quantity of smoke, or any other signal to a fire receiver (not shown), and a receiving circuit for receiving a polling signal or any other signal from the fire receiver and for sending the received signal to the microcomputer 10. An indicator lamp 51 lights when the smoke type fire detector shown in FIG. 1 detects a fire. A constant voltage circuit 60 supplies constant voltage to the microcomputer 10.

An internal temperature detecting unit 70 detects an internal temperature of the smoke type fire detector 1, and the unit 70 includes diodes D1 and D2 lying in the smoke type fire detector 1 and detecting an internal temperature of the smoke-dependent fire detector 1, and a resistor R1 connected in series with these diodes D1 and D2. Specifically, one terminal of the resistor R1 is connected to a power line Vcc, and the other terminal thereof is connected to an anode of the diode D1. A cathode of the diode D1 is connected to an anode of the diode D2. A cathode of the diode D2 is grounded. A junction between the other terminal of the resistor R1 and the anode of the diode D1 serves as an output terminal of the internal temperature detecting unit 70. The internal temperature detecting unit 70 utilizes the temperature characteristics of the diodes D1 and D2 relative to the voltage across the diodes D1 and D2 in order to detect an internal temperature of the smoke type fire detector 1. The diodes D1 and D2 are preferably located in the vicinity of the light emitting element 31 and light receiving element 41.

The internal temperature detecting unit 70 is an example of a temperature detecting means for detecting an ambient temperature at a light emitting element and a light receiving element. The microcomputer 10 is an example of a smoke density identifying means for identifying a smoke density using an output level of the light receiving element. The microcomputer 10 is also an example of a temperature compensating means for correcting an output level of the light receiving element.

Next, the operation of the aforesaid embodiment will be described.

Figure 2:
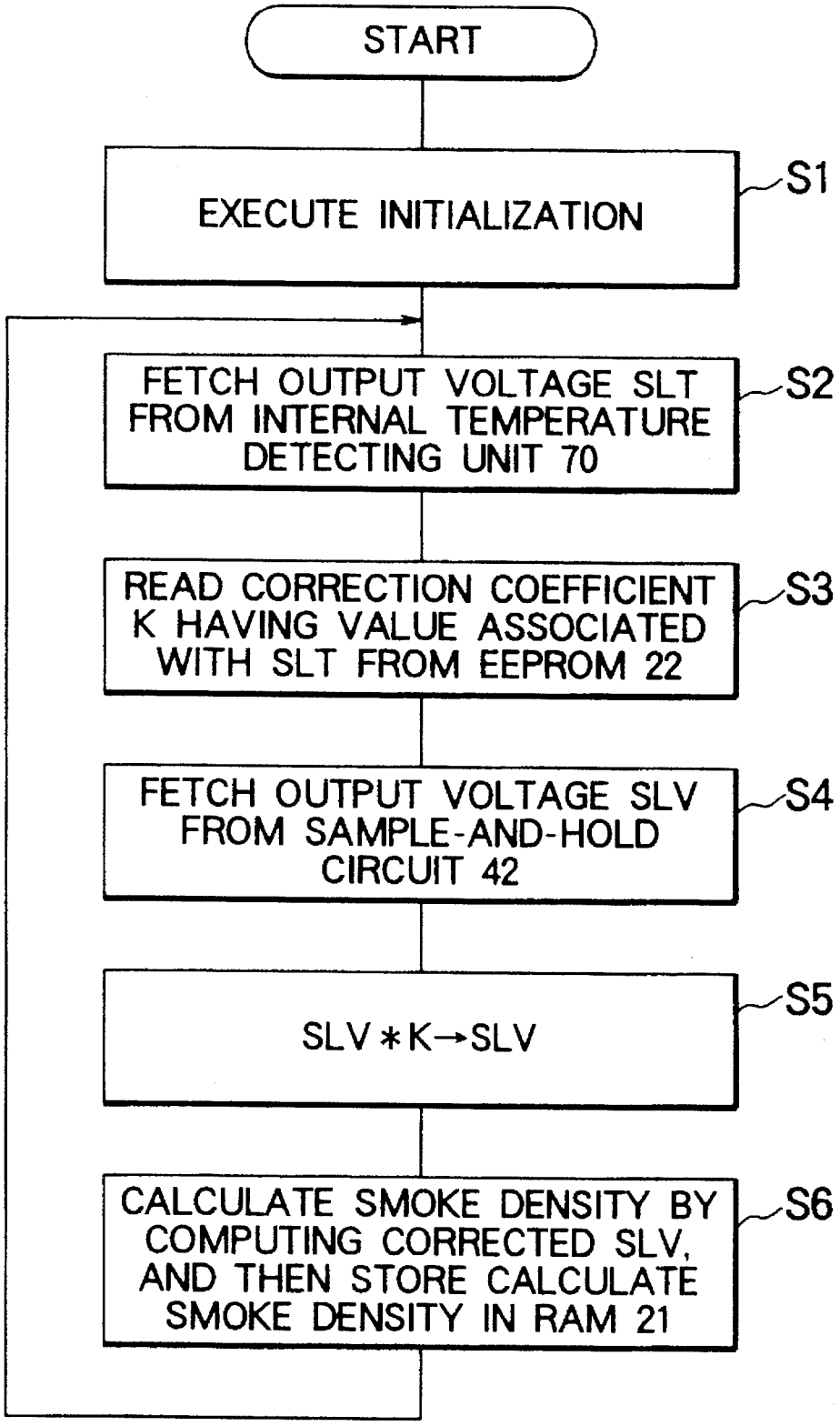
FIG. 2 is a flowchart showing the operations to be executed by a microcomputer in the above embodiment.

FIG. 2 is a flowchart showing the operations to be executed by the microcomputer 10.

Firstly, initialization is executed (step S1). The output voltage SLT, which is converted into digital data by an A/D converter in the microcomputer 10, is fetched from the internal temperature detecting unit 70, and placed in the RAM 21 (step S2). The correction coefficient K having a value associated with the output voltage SLT of the internal temperature detecting unit 70 is read from the EEPROM 22, and then placed in the RAM 21 (step S3). The output voltage SLT of the internal temperature detecting unit 70 is associated with an ambient temperature at the light emitting element 31 and light receiving element 41. The correction coefficient K is used to compensate for an error resulting from a fluctuation in output voltage SLV of the sample-and-hold circuit 42 due to an internal temperature. The correction coefficient K therefore assumes different values associated with internal temperatures of the smoke type fire detector 1, that is, values of the output voltage SLT of the internal temperature detecting unit 70 (these values of the correction coefficient K are stored in the EEPROM 22 in advance). The correction coefficient K having a value associated with the output voltage SLT representing an internal temperature is read from the EEPROM 22.

The output voltage SLV, which is converted into digital data by the A/D converter in the microcomputer 10, is fetched from the sample-and-hold circuit 42, and stored in the RAM 21 (step S4). The stored output voltage SLV is multiplied by the correction coefficient K, thus correcting the output voltage SLV of the sample-and-hold circuit 42 (step S5). A smoke density is calculated based on the corrected output voltage SLV. The result of calculation is stored in the RAM 21 (step S6). With a request sent from the fire receiver, the calculated smoke density (that is, a signal representing a physical quantity of smoke) is sent to the fire receiver.

According to the aforesaid embodiment, when the internal temperature of the smoke type fire detector 1 rises or drops, a change in quantity of light emanating from the light emitting element 31 and a change in output level of the light receiving element 41 both resulting from a temperature change can be compensated. This enables accurate detection of a smoke density.

In the above embodiment, the resistor R1 is connected to the power line Vcc, and the diodes D1 and D2 are grounded. On the contrary, unless the voltage on the power line Vcc fluctuates with temperature, the resistor R1 may be grounded, and the diodes D1 and D2 may be connected to the power line Vcc.

Figure 3:
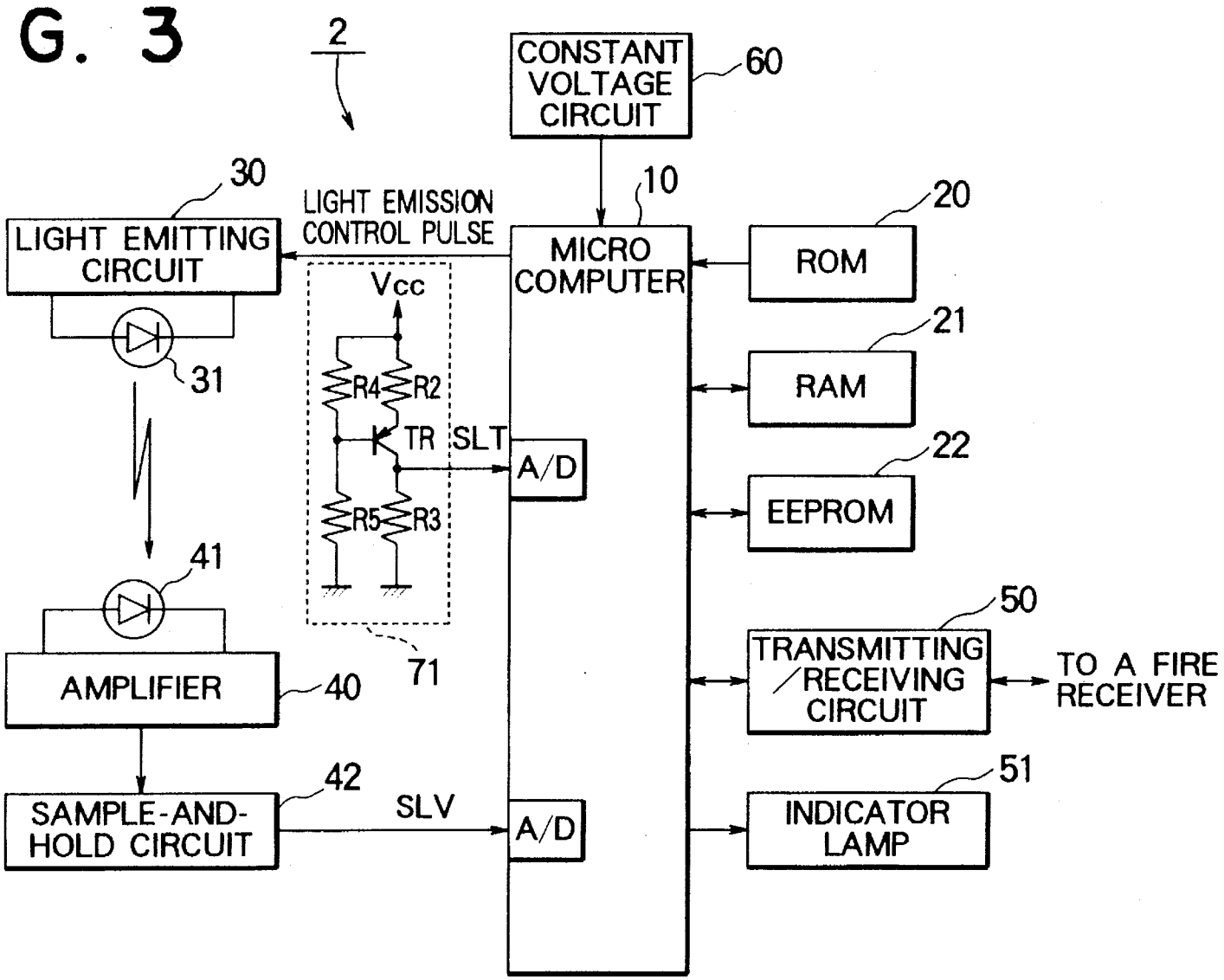
FIG. 3 is a block diagram showing a smoke type fire detector of another embodiment of the present invention.

FIG. 3 is a block diagram showing a smoke type fire detector 2 of another embodiment of the present invention.

The smoke type fire detector 2 shown in FIG. 3 is fundamentally identical to the smoke type fire detector 1 shown in FIG. 1. However, an internal temperature detecting unit 71 is included in place of the internal temperature detecting unit 70.

The internal temperature detecting unit 71 detects an internal temperature of the smoke type fire detector 2, comprising a transistor TR and resistors connected to the transistor TR all of which are located in the vicinity of the light emitting element 31 and light receiving element 41. More particularly, the transistor TR is a pnp transistor, resistors R2 and R3 are an emitter resistor and a collector resistor respectively, and resistors R4 and R5 apply fractions of an applied voltage to the base of the transistor TR. The internal temperature detecting unit 71 utilizes the temperature characteristic of the transistor TR regarding the base-emitter voltage of the transistor TR in order to detect an internal temperature.

The base voltage of the transistor TR is held at a substantially constant value by means of the resistors R4 and R5. When the base-emitter voltage of the transistor TR fluctuates due to a temperature, the fluctuation is detected as a change in value of the voltage across the resistor R2. An emitter current Ie flows through the resistor R2, and a collector current Ic flows through the resistor R3. If a current amplification factor set in the transistor TR has a sufficiently large value, the Ic value is approximately equal to the Ie value.

Assuming that the base-emitter voltage fluctuates by a value $\Delta V$ due to a temperature, the voltage across the resistor R2 also fluctuates by the $\Delta V$ value. As a result, a change $\Delta Ie$ in emitter current is provided as a product of the $\Delta V/R2$ (R2: resistance of the resistor R2). Since the current change $\Delta Ie$ is detected to have a value substantially equivalent to a change in collector current $\Delta Ic$, therefore the voltage across the resistor R3 to be detected by the A/D converter in the microcomputer 10 fluctuates by a value resulting from $\Delta V \times R3/R2$ (R3: resistance of the resistor R3). When the circuitry is such that the resistance of the resistor R3 is larger than the resistance of the resistor R2, a fluctuation $\Delta V$ of the base-emitter voltage is detected as a value amplified by a product R3/R2 by means of the A/D converter. This results in the improved precision in detecting a temperature change.

Figure 4:
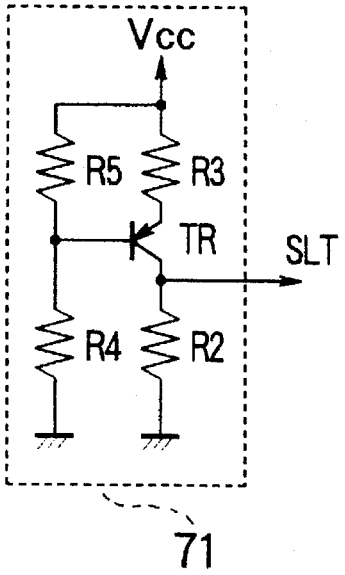
FIGS. 4 to 7 are circuit diagrams showing other embodiments of an internal temperature detecting unit according to the present invention.

An npn transistor shown in FIG. 4 may be employed instead of the pnp transistor shown in FIG. 3. This variant provides the same advantage as the aforesaid embodiment. In this variant, resistors R2 and R4 are connected to the emitter and base of the npn transistor respectively. The other terminals of the resistors R2 and R4 are grounded. Resistors R3 and R5 are connected to the collector and base of the npn transistor respectively. The other terminals of the resistors R3 and R5 are connected to the power line Vcc.

The aforesaid embodiment utilizes the temperature characteristics of semiconductor elements. For example, the diodes D1 and D2 in FIG. 1 provide forward voltages. A difference in value between the forward voltages provided by a plurality of diodes at the same temperature is larger than a difference in deviation between voltages associated with temperatures. The difference may cause an error of a detected temperature.

For minimizing the error, the procedure below would be preferred. That is to say, a given temperature and a forward voltage provided at the given temperature are stored as initial values in the EEPROM 22. A difference from the initial value of the given temperature is calculated by computing a deviation of an output of the temperature detecting unit from the initial value, and then added to or subtracted from the initial value of the given temperatures. Thus, an ambient temperature is identified. This procedure helps minimize a difference in value between the forward voltages of the diodes.

The above procedure can apply to the internal temperature detecting unit 71 using the transistor TR shown in FIG. 3, and still provides the aforesaid advantage in minimizing a fluctuation of the base-emitter voltage of the transistor TR.

Figure 5:
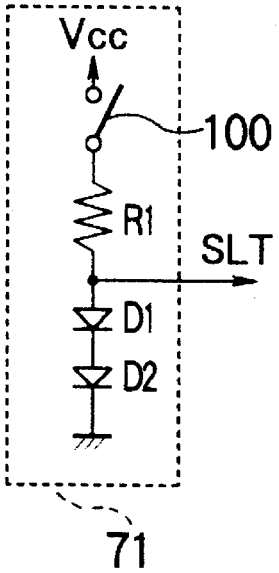
Figure 6:
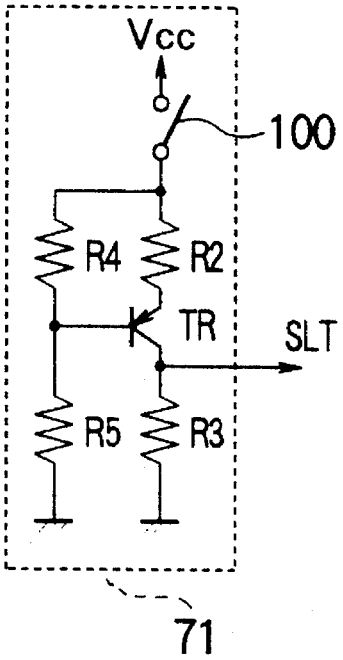
Figure 7:
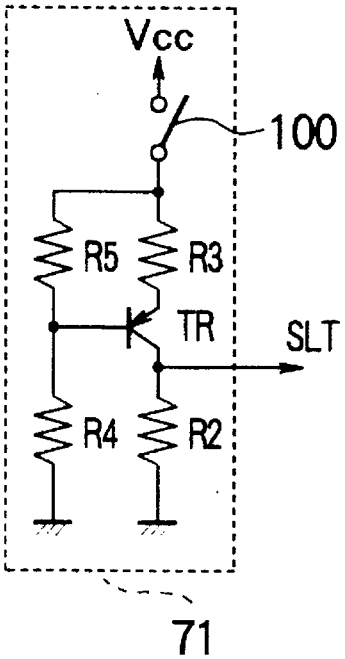

A switch 100 may be interposed, as shown in FIGS. 5 to 7, between the resistor R1 and power line Vcc in FIG. 1, between the resistors R4 and R2 and the power line Vcc in FIG. 3, or between the resistors R5 and R3 and the power line Vcc in FIG. 4. Only for detecting a temperature, the microcomputer 10 may turn on the switch 100. This contributes to the reduction in current consumed by the temperature detecting unit 70 or 71. More particularly, the temperature detecting means is supplied power under the control of a control means for controlling power supply. Only for temperature detection, the control means supplies power to the temperature detecting means.

In the aforesaid embodiment, when the internal temperature of the smoke type fire detector 1 or 2 changes, the output level of the light receiving element 41 is corrected. When a smoke density is detected by comparing the output level of the light receiving element 41 with a given reference level, for example, a fire identification reference level, the reference level may be corrected according to a temperature change in the smoke type fire detector 1 or 2.

In any of the aforesaid embodiments, a signal representing a detected physical quantity of smoke is transmitted to the control and indicating equipment. Alternatively, the smoke type fire detector may identify a fire by itself and transmit a fire signal. Even in this variant, the output voltage SLV of the sample-and-hold circuit 42 or the fire identification reference level may be corrected according to the output voltage SLT of the internal temperature detecting unit 70 or 71.

In the above embodiments, even when temperature characteristics of respective detectors are combined to present a complex temperature change characteristic, optimal temperature compensation coefficients are stored in association with temperatures in an EEPROM or ROM and used selectively. The embodiments can therefore cancel out temperature changes which could not be canceled out by means of a conventional uniform method of temperature compensation using a thermistor or any other temperature compensation element.

The temperature correction coefficient K to be stored in the EEPROM 22 can assume various values determined for each detector so that when temperature compensation is not performed, the values are inconsistent with values defined by the temperature change characteristic of each detector. When detectors have the same temperature change characteristic, temperature correction coefficients to be shared among the detectors are stored in a ROM. This variant also provide the advantage described above.

According to the present invention, even when an internal temperature of a smoke type fire detector changes, a smoke density can be detected accurately.

What is claimed is:

1. A smoke type fire detector comprising:

a light emitting element;

a light receiving element which receives scattered light emitted from said light emitting element and scattered by smoke particles;

an amplifier for amplifying the output level of said light receiving element;

a memory having predetermined temperature correction coefficients stored therein;

a temperature detecting means for detecting an ambient temperature at said light emitting element and said light receiving element; and, a microcomputer coupled to said light emitting element and to said amplifier and to said memory and to said temperature detecting means, said microcomputer including (a) means for accessing said memory and retrieving a temperature correction coefficient corresponding to said ambient temperature detected by said temperature detecting means, (b) means for calculating a temperature compensated output value or a temperature compensated reference value by applying said temperature correction coefficient to a respective one of an output level of said amplifier or a given reference level, and (c) means for detecting a smoke density by comparing the temperature compensated reference value or the temperature compensate output value with a respective one of the output level of said amplifier or the given reference level;

wherein said amplifier includes semiconductor elements, and wherein said temperature correction coefficients are for correcting an overall temperature characteristic of the combination of said light emitting and light receiving elements and said amplifier.

2. A smoke type fire detector according to claim 1, wherein said temperature detecting means includes at least one diode and utilizes a temperature characteristic of said diode relative to a voltage across said diode.

3. A smoke type fire detector according to claim 1, wherein said temperature detecting means includes a transistor and utilizes a temperature characteristic of said transistor relative to a base-emitter voltage of said transistor.

4. A smoke type fire detector according to one of claims 1, 2 or 3, wherein said microcomputer includes means for storing an initial output of said temperature detecting means as a reference temperature in said memory, and performs temperature compensation using an ambient temperature calculated by computing a deviation, which is calculated using a subsequent output of said temperature detecting means and said initial output, and said stored reference temperature.

5. A smoke type fire detector according to claim 1, wherein said temperature detecting means includes a power supply switch controlled by said microcomputer.

* * * * *